US007387297B2

(12) United States Patent
Moore

(10) Patent No.: US 7,387,297 B2
(45) Date of Patent: Jun. 17, 2008

(54) PRINTING SYSTEM SHEET FEEDER USING REAR AND FRONT NUDGER ROLLS

(75) Inventor: Steven R. Moore, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 198 days.

(21) Appl. No.: 11/166,961

(22) Filed: Jun. 24, 2005

(65) Prior Publication Data

US 2006/0290047 A1 Dec. 28, 2006

(51) Int. Cl.
*B65H 5/26* (2006.01)

(52) U.S. Cl. ..... 271/10.11; 271/10.09; 271/113; 271/121

(58) Field of Classification Search ..... 271/10.11, 271/10.09, 113, 121, 122, 119, 126, 37
See application file for complete search history.

(56) References Cited

U.S. PATENT DOCUMENTS 3,889,824 A * 6/1975 Wood ..... 414/790.3
4,316,606 A * 2/1982 Buys et al. ..... 271/10.04
4,372,547 A * 2/1983 Yanagawa et al. ..... 271/10.11
4,579,446 A 4/1986 Fujino et al.
4,587,532 A 5/1986 Asano
4,836,119 A 6/1989 Siraco et al.
4,877,232 A * 10/1989 Nakanishi ..... 271/10.09
4,928,948 A 5/1990 Evangelista et al.
5,004,222 A 4/1991 Dobashi
5,080,340 A 1/1992 Hacknauer et al.
5,095,342 A 3/1992 Farrell et al.
5,149,077 A * 9/1992 Martin et al. ..... 271/18.3
5,159,395 A 10/1992 Farrell et al.
5,201,508 A * 4/1993 Kuo ..... 271/10.03
5,208,640 A 5/1993 Horie et al.
5,211,388 A * 5/1993 Walluk ..... 271/122
5,215,299 A * 6/1993 Luft ..... 271/160
5,272,511 A 12/1993 Conrad et al.
5,326,093 A 7/1994 Sollitt
5,342,037 A * 8/1994 Martin ..... 271/111
5,346,199 A * 9/1994 Martin et al. ..... 271/110
5,348,282 A * 9/1994 Choi et al. ..... 271/117
5,350,168 A * 9/1994 Sheridan ..... 271/122
5,435,540 A 7/1995 Martin et al.

(Continued)

FOREIGN PATENT DOCUMENTS

JP 2002179265 A * 6/2002

*Primary Examiner*—Patrick Mackey
*Assistant Examiner*—Gerald W McClain
(74) *Attorney, Agent, or Firm*—Fay Sharpe LLP

(57) ABSTRACT

A printing system sheet feeder apparatus and method is provided. The printing system feeder includes a front nudger roll positioned near the leading edge of the top sheet of a sheet stack and the front nudger roll is capable of advancing the top sheet. In addition, the printing system sheet feeder includes a separation nip aligned with the front nudger roll, the front nudger roll being capable of receiving the top sheet advanced by the front nudger roll and advancing the top sheet in a direction away from the front nudger. A rear nudger roll is positioned near the trailing edge of the top sheet and is capable of advancing the sheet directly below the top sheet while the top sheet is being advanced by the front nudger roll and/or separation nip, thereby increasing the overall sheet feeding rate to the printing system.

18 Claims, 8 Drawing Sheets

U.S. PATENT DOCUMENTS 5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.
5,884,910 A 3/1999 Mandel
5,941,518 A 8/1999 Sokac et al.
5,995,721 A 11/1999 Rourke et al.
5,996,988 A * 12/1999 Helmstadter et al. ..... 271/110
6,059,284 A 5/2000 Wolf et al.
6,125,248 A 9/2000 Moser
6,182,961 B1 * 2/2001 Wenth, Jr. ..... 271/114
6,241,242 B1 6/2001 Munro
6,297,886 B1 10/2001 Cornell
6,328,301 B1 * 12/2001 Tsujii et al. ..... 271/117
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,663,097 B2 * 12/2003 Bantle ..... 271/34
6,819,906 B1 11/2004 Herrmann et al.
2002/0078012 A1 6/2002 Ryan et al.
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0141047 A1 * 7/2004 Steinhilber et al. ..... 347/216
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2005/0280199 A1 * 12/2005 Steinhilber et al. ..... 271/121
2006/0261542 A1 * 11/2006 Collings ..... 271/265.04
2007/0096385 A1 * 5/2007 Mandel et al. ..... 271/122

* cited by examiner

PRINTING SYSTEM SHEET FEEDER USING REAR AND FRONT NUDGER ROLLS

BACKGROUND

The present disclosure relates to a xerographic printing system. More specifically, this disclosure relates to a sheet feeder system and method for feeding sheets to one or more printing modules, the sheets being fed including any kind of media appropriate for use as a substrate for printing within a xerographic printing system.

As illustrated in FIG. 1, a conventional printing system includes one or more printing modules 2, 4, 6, 8, a feeder module 10 and a finisher module 12. The printing modules 2, 4, 6, and 8 may employ a variety of configurations that include horizontal alignment, vertical alignment or an integrated vertical/horizontal alignment configuration as illustrated in FIG. 1. In addition, a printing system can include a single printing module. In general, the sheet feeder module 10 feeds a sheet of paper, plastic or other suitable physical print media for images and text to the printing modules 2, 4, 6, and 8 by way of a sheet path which connects the feeder module 10 to the printing modules 2, 4, 6, and 8. The printing modules 2, 4, 6, and 8 include marking apparatuses that are used for applying an image to the sheet which is supplied from the feeder module. After marking has been completed within the printing modules, the sheet travels to a finishing module 12 which includes any post-marking devices, such as a sorter, mailbox, inserter, interposer, folder, stapler, stacker, hole puncher, collator, stitcher, binder, envelope stuffer, postage machine, or the like.

A conventional sheet feeder module can include one or more feeders, as illustrated in FIG. 1. A conventional friction retard feeder design is illustrated in FIG. 2. This conventional design includes a separation nip 20 having a forward driven feed roll 22 and a retard roll 24 that serves as a high drag torque idler. A nudger roll 26 is generally placed a short distance back from the lead edge of the sheet stack 28. The nudger roll 26 serves to advance the top sheet(s) off of the stack 28 and into the separation nip 20. This feeder configuration is well known within the industry. This feeder technology is hampered from operating a high speeds (>100 ppm) in part because of the variable amount of time it can take to nudge the top sheet into the feed nip, i.e. acquire the sheet. Sheet feeder timing is limited by the longest acquisition time possible while still delivering sheets within the pitch time tolerances to the system. Nudging of the top sheet cannot start until the previous sheet's trail edge has cleared the nudger 26 or more generally the separation nip 20 since the feed roll 22 and the nudger roll 26 drive is generally tied together mechanically.

This disclosure provides a system and method of increasing the sheet feed rate by the addition of a rear nudger.

CROSS REFERENCE TO RELATED PATENTS AND APPLICATIONS

The following applications, the disclosures of each being totally incorporated herein by reference are mentioned:

U.S. Provisional Application Ser. No. 60/631,651 filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918 filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst et al.;

U.S. application Ser. No. 11/109,566, filed Apr. 19, 2005, entitled "MEDIA TRANSPORT SYSTEM," by Mandel et al.;

U.S. application Ser. No. 11/109,996, filed Apr. 20, 2005, entitled "PRINTING SYSTEMS," by Michael C. Mongeon et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,821, filed May 25, 2005, entitled "AUTOMATED PROMOTION OF MONOCHROME JOBS FOR HLC PRODUCTION PRINTERS," by David C. Robinson;

U.S. application Ser. No. 11/136,959, filed May 25, 2005, entitled "PRINTING SYSTEMS", by Kristine A. German et al.;

U.S. application Ser. No. 11/137,634, filed May 25, 2005, entitled "PRINTING SYSTEM", by Robert M. Lofthus et al.;

U.S. application Ser. No. 11/137,251, filed May 25, 2005, entitled "SCHEDULING SYSTEM", by Robert M. Lofthus et al.;

U.S. C-I-P application Ser. No. 11/137,273, filed May 25, 2005, entitled "PRINTING SYSTEM", by David G. Anderson et al.;

U.S. application Ser. No. 11/143,818, filed Jun. 2, 2005, entitled "INTER-SEPARATION DECORRELATOR", by Edul N. Dalal et al.;

U.S. application Ser. No. 11/146,665, filed Jun. 7, 2005, entitled "LOW COST ADJUSTMENT METHOD FOR PRINTING SYSTEMS", by Michael C. Mongeon;

U.S. application Ser. No. 11/152,275, filed Jun. 14, 2005, entitled "WARM-UP OF MULTIPLE INTEGRATED MARKING ENGINES", by Bryan J. Roof et al.;

U.S. application Ser. No. 11/156,778, filed Jun. 20, 2005, entitled "PRINTING PLATFORM", by Joseph A. Swift;

U.S. application Ser. No. 11/157,598, filed Jun. 21, 2005, entitled "METHOD OF ORDERING JOB QUEUE OF MARKING SYSTEMS", by Neil A. Frankel.

INCORPORATION BY REFERENCE

U.S. Pat. No. 5,941,518, issued to Sokac et al., the entire disclosure of which is incorporated by reference, provides a sheet feeder system.

U.S. Pat. No. 5,435,540, issued to Martin et al., the entire disclosure of which is incorporated by reference, provides a sheet feeder system.

U.S. Pat. No. 5,941,518, issued to Evangelista et al., the entire disclosure of which is incorporated by reference, provides a sheet feeder system.

BRIEF DESCRIPTION

According to one exemplary embodiment, a printing system sheet feeder apparatus is provided. The printing system feeder comprising a sheet stack including two or more sheets of media stacked in a vertical position and a front nudger roll positioned near the leading edge of the top sheet, the front nudger roll capable of advancing the top sheet. In addition, the printing system sheet feeder apparatus includes a separation nip aligned with the front nudger roll and capable of receiving the top sheet advanced by the front nudger roll and advancing the top sheet in a direction away from the front nudger. A rear nudger roll is positioned near the trailing edge of the top sheet and is capable of advancing the sheet directly below the top sheet while the top sheet is being advanced by the front nudger roll and/or separation nip.

According to another exemplary embodiment, a printing system sheet feeder apparatus is provided wherein the rear nudger roll axis of rotation is located a distance X1 from the trailing edge of the sheet stack, and the separation nip axis of rotation is located a distance X2 from the leading edge of the sheet stack. The front nudger roll engages and advances the top sheet in a direction towards the separation nip and the distance X1 is less than X2.

According to another aspect of this disclosure, a method of feeding sheets to a printing system is provided. The method comprising starting a sheet feed cycle; applying a tangential force near the leading edge of a top sheet of a sheet stack; driving the top sheet into a separation nip; removing the said force near the leading edge of the top sheet after the top sheet leading edge passes through the separation nip; driving the top sheet with the separation nip to a take-away nip, while simultaneously applying a tangential force near the trailing edge of a next sheet directly below the top sheet; and removing the tangential force from the next sheet after driving the next sheet a predetermined distance towards the separation nip.

According to another embodiment of this disclosure, a xerographic printing system is provided. The xerographic printing system comprising one or more sheet feeder apparatuses. Each sheet feeder apparatus comprising a sheet stack comprising two or more sheets of media stacked in a vertical position which includes a top sheet and a sheet directly below the top sheet, each sheet including a leading edge and a trailing edge; a front nudger roll positioned near the leading edge of the top sheet of the sheet stack, capable of advancing the top sheet; a separation nip aligned with the front nudger roll and capable of receiving the top sheet advanced by the front nudger roll and advancing the top sheet in a direction away from the front nudger; and a rear nudger roll, the rear nudger roll being positioned near the trailing edge of the top sheet and capable of advancing the sheet directly below the top sheet while the top sheet is being advanced by the front nudger roll and/or separation nip.

DETAILED DESCRIPTION

Figure 2:
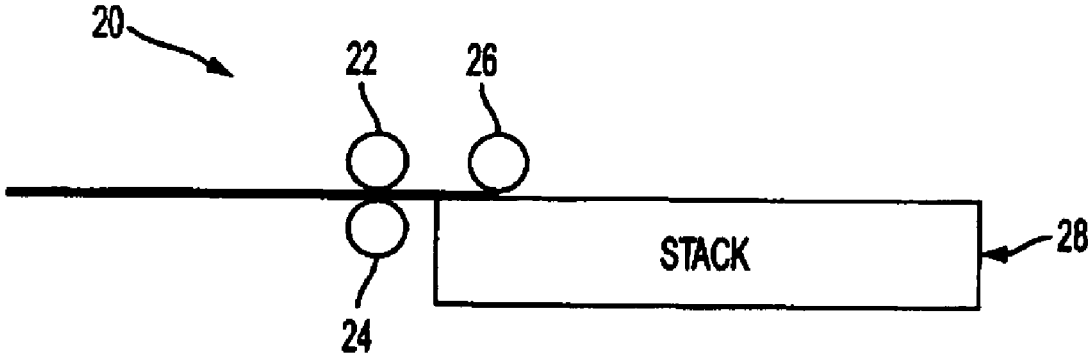
FIG. 2 PRIOR ART
FIG. 2 is a conventional embodiment of a sheet feeder apparatus.

As discussed above in the background section of this disclosure, a conventional friction retard feeder, as illustrated in FIG. 2, has the limitation of not being able to nudge the sheet directly below the top sheet until the trailing edge of the top sheet clears the nudger roll 26 and/or separation nip 22. This disclosure provides an apparatus, system and method of nudging the sheet directly below the top sheet before the trailing edge of the top sheet clears the nudger roll and/or separation nip. By providing an additional independently driven rear nudger, the sheet directly below the top sheet can be advanced towards the separator nip while the top sheet is being advanced by the feeder roll and separator nip. Consequently, immediately after the top sheet clears the front nudger roll and/or separation nip, the sheet directly below this top sheet becomes the top sheet at a position closer to the separation nip, relative to the conventional configuration illustrated in FIG. 2, and the throughput of the feeder system is improved. Specifically, the acquisition or pitch time is shortened which improves the throughput of the printing system. In addition, the additional force contributed to the feeder system by the addition of this second nudger roll provides resistance to feeder jams as a result of edge welds or high curls.

Figure 1:
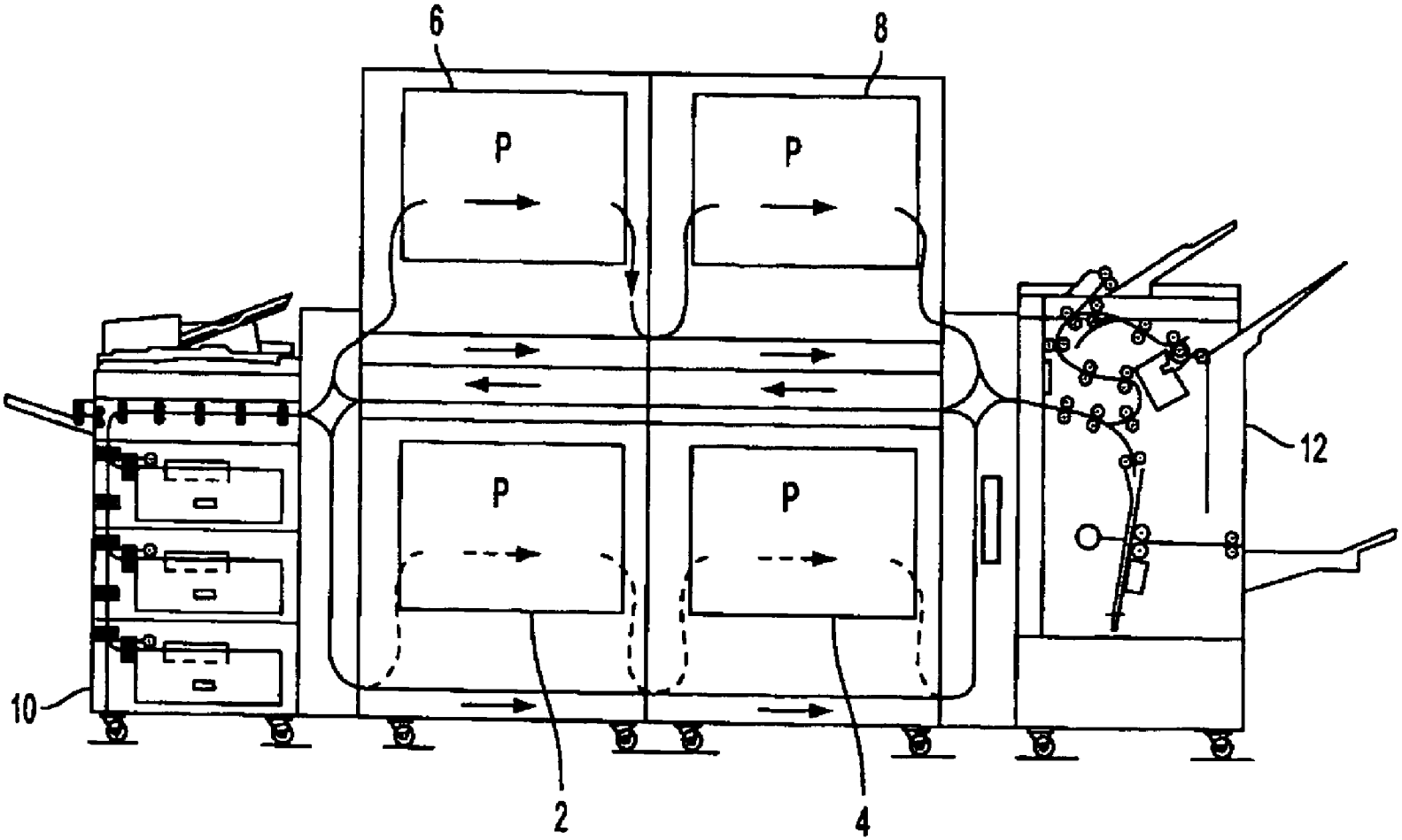
FIG. 1 PRIOR ART
FIG. 1 is an exemplary embodiment of a printing system including a conventional feeder module with multiple feeders.

In operation, the forward nudger 26 and the separation nip 20 start rotating in a forward direction (clockwise with reference to FIG. 3) in order to nudge the top sheet or sheets into the separation nip 20. The separation nip 20 then stops all but the top sheet from advancing through the separator nip 20. The separation nip 20 then drives the top sheet into a take-away roll (TAR nip, not shown). The TAR nip is capable of accelerating the sheet to a higher speed so that the sheet's trail edge will more quickly clear the separation nip 20. As illustrated in FIG. 1, the forward nudger 22 cannot contact the next sheet in the stack until the top sheet's trailing edge clears the forward nudger 22.

Figure 3:
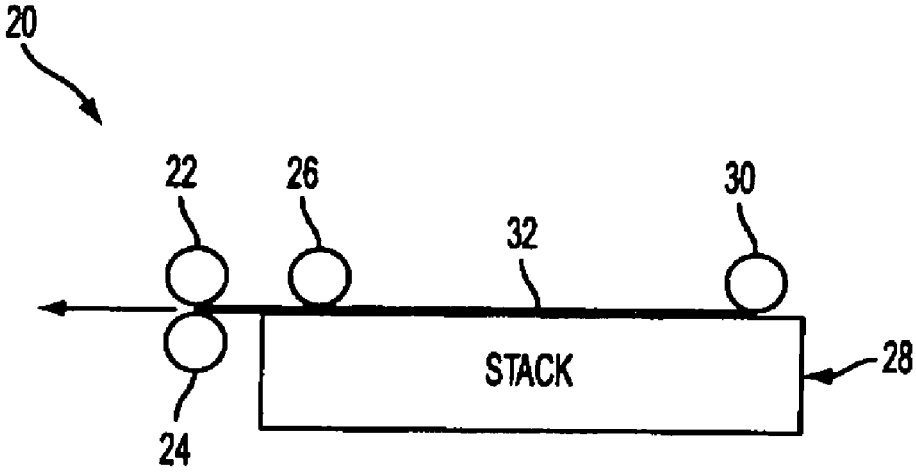
FIG. 3 is an exemplary embodiment of a sheet feeder according to one aspect of this disclosure.

As illustrated in FIG. 3, a rear nudger roll 30 has been added to the feeder illustrated by FIG. 2. A detailed description of an exemplary embodiment, and the operation thereof, of the present disclosure is provided. The illustrated exemplary embodiment of a printing system feeder includes a sheet stack 28, a rear nudger roll 30, a front nudger roll 26 and a separator nip 20. The separator nip 20 illustrated includes a feed roll 22 and a retard roll 24. In addition, illustrated is the top sheet 32 of the sheet stack 28. The rear nudger 30 is positioned near the trailing edge of the sheet stack. The rear nudger 30 is driven independently from the forward nudger roll 26, in one exemplary embodiment a small stepper motor is used for driving the forward nudger 26. Another exemplary embodiment includes a DC motor or a solenoid-operated mechanism for controlling the rear nudger roll. The rear nudger roll 30 is positioned a short distance in from the trailing edge of the sheet stack. One exemplary embodiment includes the rear nudger roll 30 as part of the sheet stack guide assembly; thereby the rear nudger roll 30 will follow the trailing edge of various media placed within the sheet stack 28.

As illustrated in FIG. 3, as the top sheet 32 is acquired by the separation nip 20, the top surface of the sheet directly below the said top sheet 32 is exposed to the rear nudger 30. With the leading edge of the top sheet 32 acquired by the separator nip 20, the front nudger roll 26 is lifted from the top sheet 32. In one embodiment this is accomplished by a solenoid linkage. Subsequently, the separator nip 20 drives the top sheet 32 to the take-away nip (not shown) or other device used to route the sheet to a printer or other printing device that receives media or sheets, such as a scanner, etc. Lifting the forward nudger 26 reduces the drive force on the top sheet 32 and reduces the possibility of multiple sheet feeds through the separation nip 20; it also enables the rear nudger 30 to operate on the subsequent sheet unencumbered by additional forces applied by the front nudger 26. As the front nudger roll 26 is lifted and the separation nip 20 begins to drive the top sheet 32, the rear nudger roll 30 is briefly cycled to nudge the sheet directly below the top sheet toward the separation nip 20. This rear nudger roll 30 cycling can also be accomplished while the front nudger roll 26 is advancing the top sheet 32 towards the separator nip 20. The addition of a rear nudger roll 30 enables the separator nip 20 to engage consecutive sheets with less time delay between sheets as compared with the conventional feeder system described with reference to FIG. 2. An additional operational feature of this exemplary embodiment of the present disclosure, as illustrated in FIG. 3, is the ability of the rear nudger roll 30 to apply additional nudging force to the top sheet 32 of the stack, i.e. in combination with the forward nudging roll 26. This additional force improves the ability of the feeder to overcome the drag of the top sheet 32 which improves the overall performance of the feeder system and printing system.

There are various systems and methods that can be used to apply a net normal force to the trailing edge of a sheet. As described heretofore, a rear nudger roller 30 arrangement has been described. However, as will be described below, other arrangements can be employed as one of ordinary skill in the art will appreciate.

Figure 4:
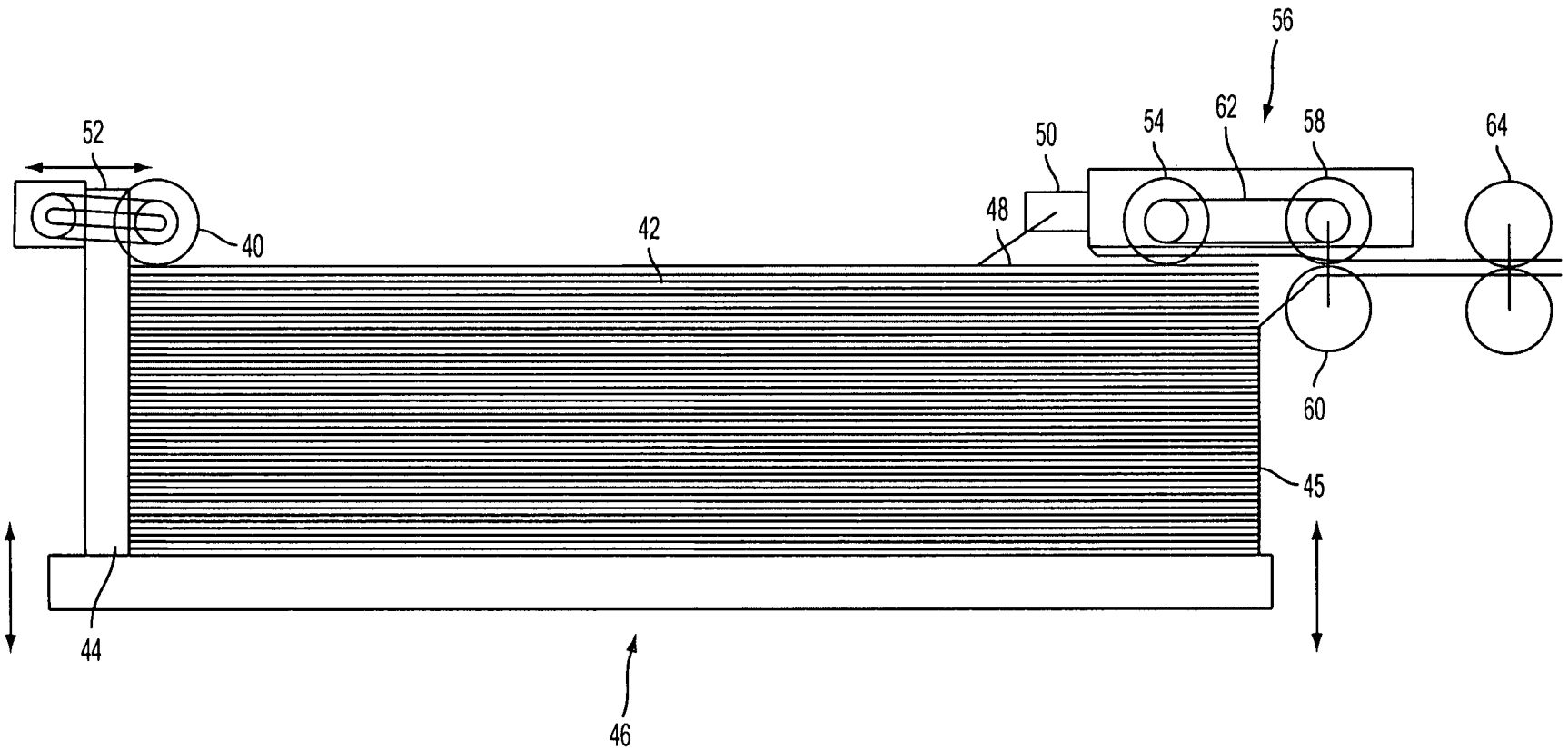
FIG. 4 is an exemplary embodiment of a sheet feeder according to another aspect of this disclosure.

Referencing FIG. 4 illustrated is another exemplary embodiment of the present disclosure that incorporates a rear nudger roll 40. Included are a sheet stack 42 aligned by a stack trail edge guide 44 and a stack lead edge guide 45. An elevator sheet lift plate 46 positions the sheet stack 42 vertically in a position to enable the top sheet 48 to be advanced within the feeder apparatus 50. A sheet stack height sensor monitors the height of the sheet stack for controlling the elevator lift plate 46 (mechanism not shown). As illustrated, this embodiment also includes a rear nudger roll 40 coupled to a belt drive mechanism 52 a front nudger roll 54 coupled to a separator nip 56. The separator nip included a feed roll 58and retard roll .The feed roll 58 of the separator nip 56 is driven at the same speed as the front nudger roll 54 using a drive belt coupling arrangement 62. Not illustrated is the driving mechanism for providing the force necessary to drive the coupled front nudger 54 roll and feed roll 58. This is accomplished by a drive mechanism similar to the arrangement illustrated for the rear nudger roll drive mechanism 52 or other arrangements which are known to those of ordinary skill in the art, such as a gear driven arrangement. An independently driven take-away nip 64 provides the necessary force to advance the top sheet 48 from the separation nip 56 and accelerate this sheet to a feed path (not shown) coupled to a printing system.

Figure 5:
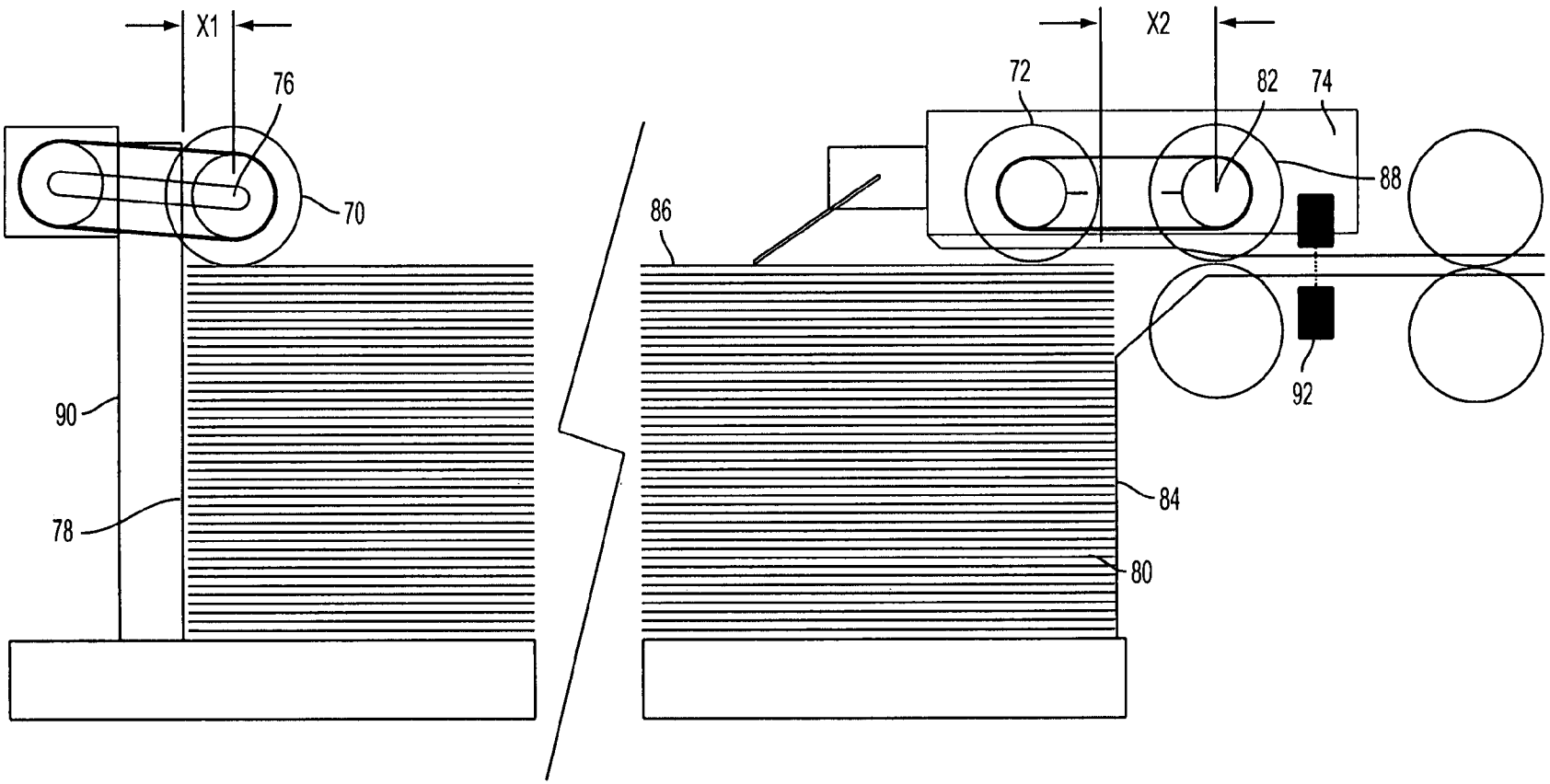
FIG. 5 is an exemplary embodiment of a sheet feeder according to another aspect of this disclosure.

Illustrated in FIG. 5. is a detailed representation of another embodiment of the present disclosure, illustrated is the dimensional relationship between the rear nudger roll 70 and front nudger roll 72/separation nip 74 arrangement. By positioning the rear nudger roll axis of rotation 76 a distance X1 from the trailing edge 78 of the sheet stack 80 and positioning the separator nip axis of rotation 82 a distance X2 from the leading edge 84 of the sheet stack, where X1 is slightly less than X2, the rear nudger roll 76 can move the top sheet 86 a distance X1 toward the feed nip 74 before losing control of its trailing edge. Designing X1 to be slightly less than X2 eliminates the possibility of the rear nudger roll 70 driving a multitude of sheets into the fee nip 74, which is known to increase the probability of a multifeed, wherein two or more sheets are simultaneously fed.

As will be appreciated by those of ordinary skill in the art, other designs can be used to prevent the rear nudger roll 70 from driving multiple sheets into the feed nip 74. For example, this could be accomplished by one or more top sheet position sensors and the necessary signals to control the driving mechanisms of the rear nudger roll 70 and feeder roll 88.

The rear nudger roll 70 of FIG. 5 is shown attached to the trail edge guide 90. This arrangement can be user adjustable or a fixed position. Other arrangements for mounting the rear nudger roll 70 are possible to accommodate retrofitting existing sheet feeder systems to employ a rear nudger roll 70

The exemplary embodiment illustrated in FIG. 5 also includes a sheet acquisition sensor 92. This sensor detects the leading edge, trailing edge and body of the top sheet being fed. The presence of the trailing edge of the top sheet indicates a sheet has been fed and prompts the acquisition of the next sheet.

Figure 6:
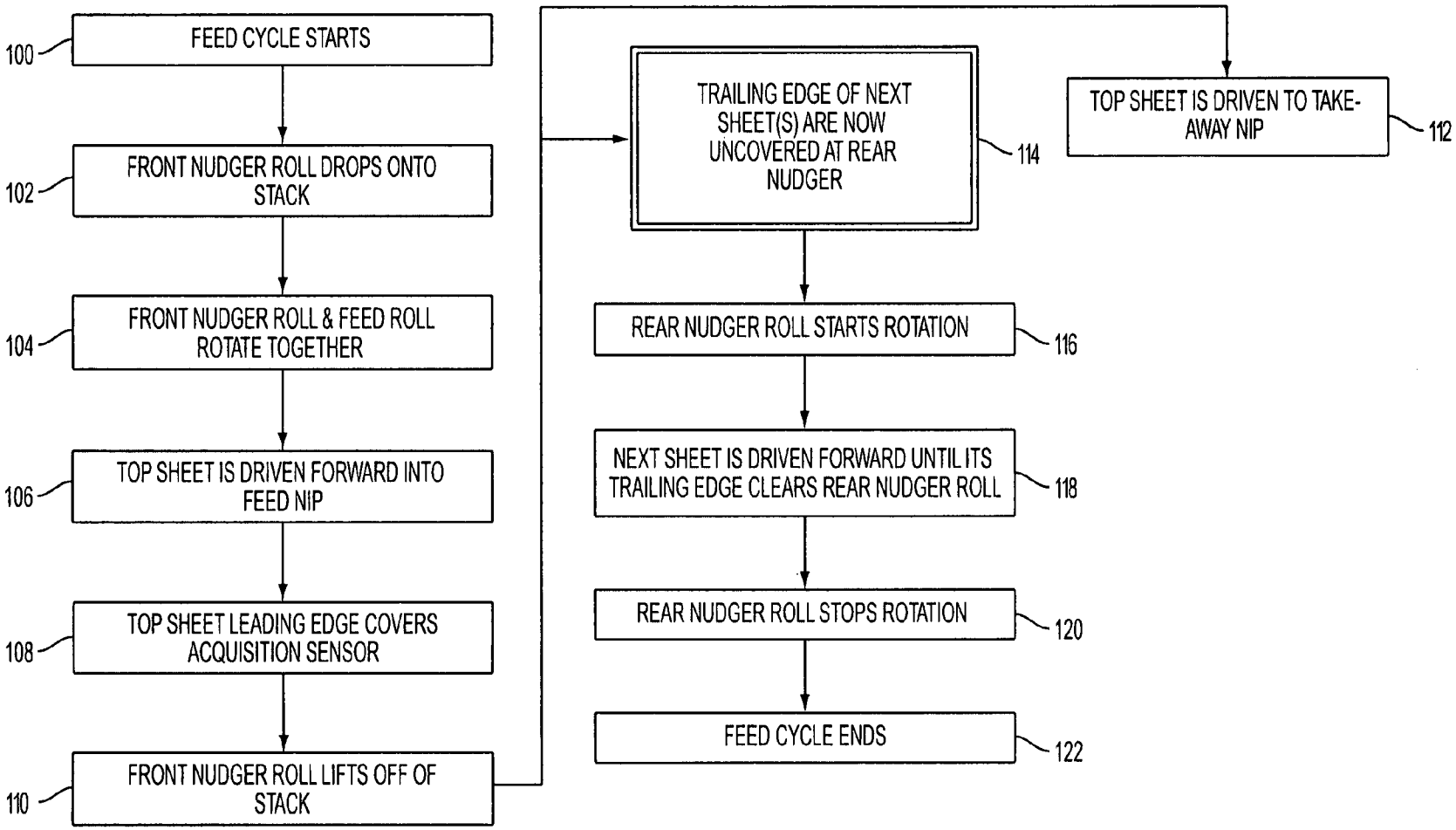
FIG. 6 is an exemplary embodiment of a rear nudger according to one aspect of this disclosure.

With reference to FIG. 6, the operational sequences of the exemplary embodiments of FIG. 4 and FIG. 5 will be described. The sheet feed cycle starts 100 after the printing system is turned on and requires a sheet for marking or the trailing edge of the top sheet is detected by an acquisition sensor or another detecting process. Subsequent to the sheet feed cycle starting 100, the front nudger roll drops onto the sheet stack 102. Next, the front nudger roll and feed roll rotate together 104 and this drives the top sheet between the feed nip and retard roll of the separation nip 106. As the top sheet advances, the leading edge of the sheet covers the acquisition sensor 108 and the front nudger roll is lifted off of the sheet stack 110. With the front nudger roll lifted from the sheet stack, the feeder roll drives the top sheet to the take-away nip 112 for advancing the sheet into the sheet pathway of the printing system.

As the top sheet is driven to the take-away nip, a trailing edge portion of the next sheet in the sheet stack is exposed to the rear nudger roll 114. The rear nudger roll starts to rotate 116 in a direction to advance this sheet towards the separation nip; the sheet being driven by the rear nudger roll until the trailing edge of the sheet clears the rear nudger roll 118. At this point, the rear nudger roll stops rotation 120 and the feed cycle ends 122.

At the beginning of the next feed cycle, the leading edge of the top sheet will be positioned between the front nudger roll and the feeder roll. As a result, less time is required to feed consecutive sheets compared with a conventional sheet feeder without a rear nudger roll.

As will be appreciated by those of ordinary skill in the art, the described control sequences can be implemented using a variety of techniques, including but not limited to, a computer or micro processor control system, etc. In addition, there are various designs and methods that can be employed to manage the net normal force between the rear nudger roll and the trailing edge of the sheet stack. One approach is to vertically suspend the rear nudger assembly using a nearly zero-rate spring. The rear nudger roll sits on the trailing edge portion of the sheet stack with an approximately constant normal force, despite relative height variations inherent in controlling the sheet stack height at its leading edge.

Figure 7:
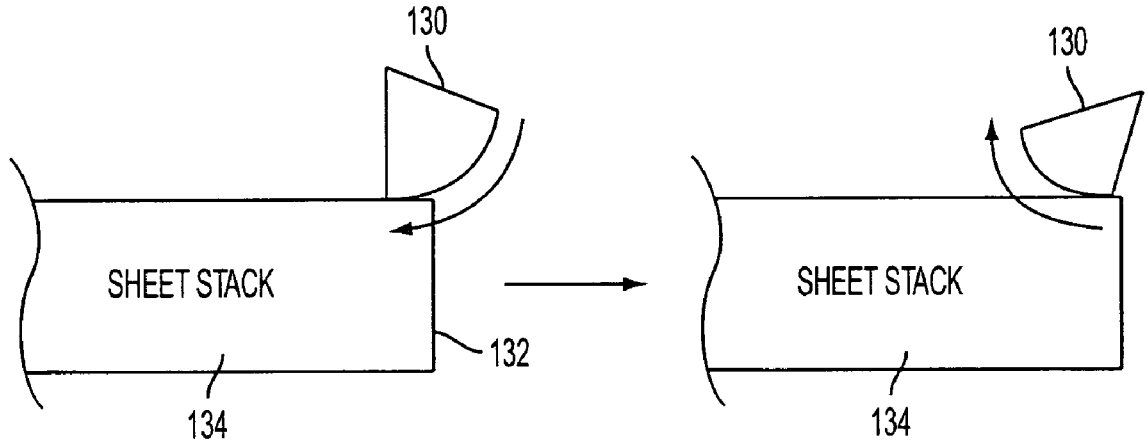
FIG. 7 is an exemplary operational flow chart according to one aspect of this disclosure.

With reference to FIG. 7, another exemplary embodiment is illustrated to allow relief of the rear nudger roll normal force between feed cycles utilizing a rear nudger segment 130 similar to a D-roll. The D-roll type segment 130 applies a nudging force to the trailing edge 132 of the sheet stack 134 as its active periphery contacts the sheet stack 134. As the D-roll type segment 130 pivots upward it will separate from the sheet stack 134. By designing the active peripheral contact length appropriately, the top sheet advancement distance is controlled. The D-roll type segment 130 will continue to rotate to an initial feed cycle position before advancing the next sheet of the stack 134.

Another embodiment of the rear nudger roll assembly includes a conventional solenoid and solenoid linkage arrangement to unload and load the rear nudger roll relative to the sheet stack.

To illustrate the timing benefits of the present disclosure, below are some exemplary values for a conventional sheet feeder as compared to a sheet feeder incorporating a rear nudger roll as disclosed heretofore.

Assumptions:

216 mm sheet process length;

400 mm/s front nudger and separation nip speed;

1000 mm/s take-away roll speed of take-away nip;

100 mm distance from the separation nip to the take-away nip; and 0.150 s maximum time allocation to nudge sheet to separation nip.

Based on the assumptions listed above, the following chart indicates the expected performance characteristics of the respective sheet feeders.

| | Conventional Sheet Feeder | Rear Nudger Feeder |
|---|---|---|
| time to acquire sheet | 0.150 s | 0.050 s |
| transport time to take-away roll | 0.250 s | 0.250 s |
| time for trailing edge to clear the separation nip | 0.116 s | 0.116 s |
| Total time/Maximum feed speed | 0.516 w/116 ppm | 0.416 s/144 ppm |

As indicated by the chart, if the rear nudger is capable of reducing the maximum time to acquire a sheet from 0.150 s to 0.050 s, then the maximum feed rate is increased from 116 ppm to 144 ppm.

Figure 8:
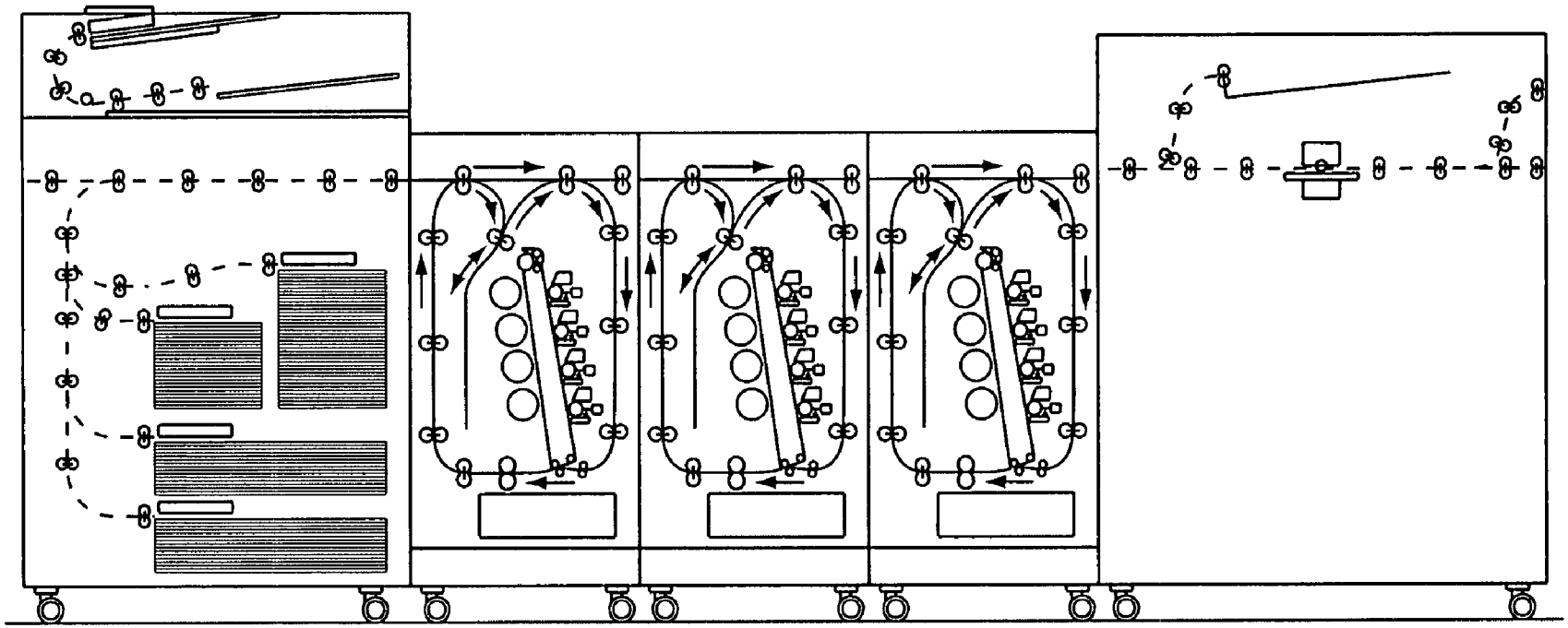
FIG. 8 is another exemplary embodiment of a printing system including multiple sheet feeders.
Figure 9:
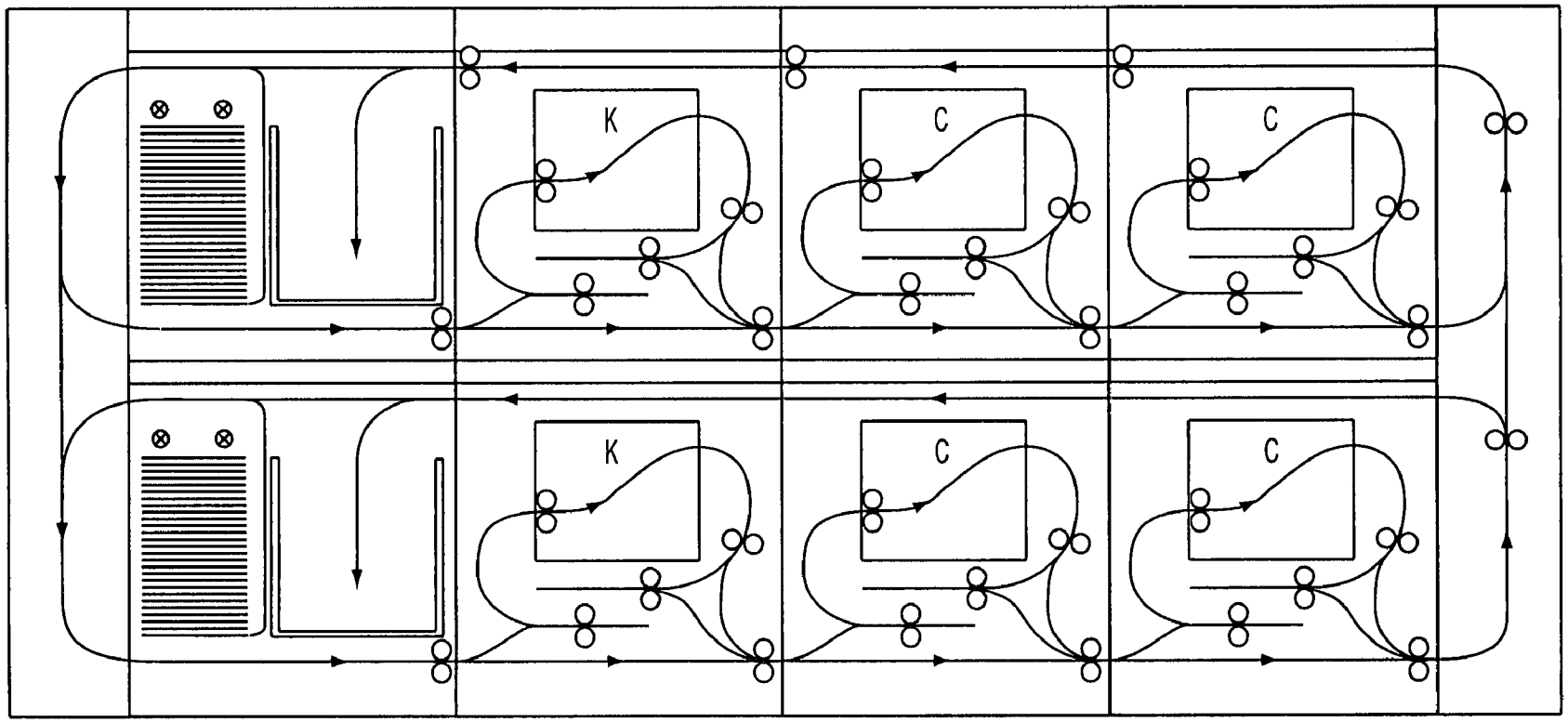
FIG. 9 is another exemplary embodiment of a printing system including multiple sheet feeders.

Referencing FIG. 8 and FIG. 9, these drawings illustrate possible configurations of multi-feeder arrangements incorporating a rear nudger roll as disclosed to supply substrates to multiple printing modules for marking. As illustrated, FIG. 8 represents a horizontally integrated printing system. FIG. 9 represents a horizontally and vertically integrated system. Both FIG. 8 and FIG. 9 include sheet feeder configurations adaptable to include a rear nudger as described within this present disclosure.

It will be appreciated various features of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system sheet feeder apparatus comprising:

an initial sheet stack comprising two or more sheets of media stacked in a vertical position which includes a top sheet and a sheet directly below the top sheet, each sheet including a leading edge and a trailing edge wherein all leading edges and trailing edges are vertically aligned;

a front nudger roll positioned directly above the initial sheet stack and near the leading edge of the top sheet of the initial sheet stack, the front nudger roll in physical contact with the top sheet of the initial sheet stack, and the front nudger roll adapted to advance the top sheet from the initial sheet stack;

a separation nip aligned with the front nudger roll and capable of receiving the top sheet advanced by the front nudger roll and advancing the top sheet in a direction away from the front nudger roll; and a rear nudger roll, the rear nudger roll being positioned directly above the initial sheet stack and near the trailing edge of the top sheet and adapted to advance, from the initial sheet stack, the sheet directly below the top sheet while simultaneously, the top sheet is being advanced by the front nudger roll, or the separation nip, or the front nudger roll and the separation nip, wherein the rear nudger roll is adjustably mounted or fixed to a sheet stack trailing edge guide.

2. The apparatus of claim 1, further comprising:

a take-away nip aligned with the separator nip, the take-away nip adapted to receive the top sheet advanced by the separation nip, the take-away nip adapted to advance the top sheet to a sheet path operatively connected to the sheet feeder apparatus and the take-away nip adapted to advance the sheet at speeds greater that the speed of the separation nip.

3. The apparatus of claim 2, the take away nip further comprising:

a drive roll; and an idler roll.

4. The apparatus of claim 1 further comprising:

a sheet stack tray comprising an elevator lift plate to advance the sheet stack in a vertical direction;

a sheet stack trail edge guide for controlling the lateral position of the sheet stack in one direction;

a sheet stack lead edge guide for controlling the lateral position of the sheet stack in another direction; and a sheet stack height sensor.

5. The apparatus of claim 1, further comprising:

a belt drive mechanism integrated with the front nudger roll and the separation nip, wherein the front nudger roll and the separation nip rotate in a direction that advances the top sheet in a direction oriented from the front nudger roll to the separation nip.

6. The apparatus of claim 1, the separation nip further comprising:

a mechanically driven feed roll; and a retard roll, the feed roll and the retard roll aligned to advance one sheet advanced from the front nudger.

7. The apparatus of claim 1, the rear nudger roll further comprising:

a mechanically driven roll.

8. The apparatus of claim 1, the rear nudger roll further comprising:

a D-roll segment to advance the top sheet.

9. The apparatus of claim 1, wherein the rear nudger roll axis of rotation is located a distance X1 from the trailing edge of the sheet stackand the separation nip axis of rotation is located a distance X2 from the leading edge of the sheet stack, and the front nudger roll engages and advances the top sheet in a direction towards the separation nip.

10. The apparatus of claim 9, wherein the distance X1 is less than distance X2.

11. The apparatus of claim 9, wherein the distance X1 is approximately equal to distance X2.

12. The apparatus of claim 9, wherein the rear nudger roll engages and advances the sheet directly below the top sheet in a direction towards the separation nip and for a distance X1.

13. The apparatus of claim 12, further comprising:

a sheet acquisition sensor aligned with the separation nip to detect the leading edge of a sheet advancing from the separation nip.

14. The apparatus of claim 1, further comprising:

a nearly zero-rated spring wherein the rear nudger roll is vertically suspended above the sheet stack by the spring and the rear nudger roll engages the sheet directly below the top sheet.

15. A method of feeding sheets to a printing system including a sheet stack including two or more sheets of media stacked in a vertical position which includes a top sheet and a sheet directly below the top sheet, each sheet including a leading edge and a trailing edge wherein all leading edges and trailing edges are vertically aligned the method comprising:

starting a sheet feed cycle;

applying a tangential force near the leading edge of the top sheet of the sheet stack, the tangential force applied with a first nudger roll positioned near the leading edge of the top sheet of the sheet stack and the first nudger roll is in physical contact with the top sheet of the sheet stack;

driving the top sheet into a separation nip;

removing the tangential force near the leading edge of the top sheet after the top sheet leading edge passes through the separation nip;

driving the top sheet with the separation nip to a take-away nip, while simultaneously applying a tangential force near the trailing edge of a next sheet directly below the top sheet the tangential force applied with a second nudger roll positioned near the trailing edge of the next sheet of the sheet stack; and wherein the second nudger roll is adjustably mounted or fixed to a sheet stack trailing edge guide, removing the tangential force from the next sheet after driving the next sheet a predetermined distance towards the separation nip.

16. A xerographic printing system comprising:

one or more sheet feeder apparatuses each sheet feeder apparatus comprising:

an initial sheet stack comprising two or more sheets of media stacked in a vertical position which includes a top sheet and a sheet directly below the top sheet, each sheet including a leading edge and a trailing edge wherein all leading edges and trailing edges are vertically aligned;

a front nudger roll positioned directly above the initial sheet stack and near the leading edge of the top sheet of the initial sheet stack, the front nudger roll in physical contact with the top sheet of the initial sheet stack, and the front nudger roll, capable of advancing the top sheet from the initial sheet stack;

a separation nip aligned with the front nudger roll, the separation nip adapted to receive the top sheet advanced by the front nudger roll and the separation nip adapted to advance the top sheet in a direction away from the front nudger; and a rear nudger roll, the rear nudger roll being positioned directly above the initial sheet stack near the trailing edge of the top sheet and adapted to advance, from the initial sheet stack, the sheet directly below the top sheet while the top sheet is being advanced by the front nudger roll, the separation nip, or the front nudger roll and the separation nip, wherein the second nudger roll is adjustably mounted or fixed to a sheet stack trailing edge guide .

17. A xerographic printing system according to claim 16, further comprising:

a take-away nip aligned with the separator nip, the take-away nip adapted to receive the top sheet advanced by the separation nip, the take-away nip adapted to advance the top sheet to a sheet path operatively connected to the sheet feeder apparatus and the take-away nip adapted to advance the sheet at speeds greater than the speed of the separation nip.

18. A xerographic printing system according to claim 17, further comprising:

one or more printing modules one or more feed modules; and one or more finishing modules.

* * * * *